United States Patent [19]

Kawolics

[11] Patent Number: 4,881,664

[45] Date of Patent: Nov. 21, 1989

[54] DISPOSABLE VALVE WITH DISK-LIKE VALVE ELEMENT

[75] Inventor: Raymond P. Kawolics, Solon, Ohio

[73] Assignee: The Meyer Company, Cleveland, Ohio

[21] Appl. No.: 243,695

[22] Filed: Sep. 13, 1988

[51] Int. Cl.[4] ..... B67D 5/32

[52] U.S. Cl. ..... 222/153; 222/402.22; 222/513; 222/541

[58] Field of Search ..... 222/402.22, 402.23, 222/513, 541, 153

[56] References Cited

U.S. PATENT DOCUMENTS

| | | | |
|---|---|---|---|
| 2,704,621 | 3/1955 | Soffer . | |
| 2,829,806 | 4/1958 | Tedaldi . | |
| 2,881,808 | 4/1959 | St. Germain . | |
| 2,965,270 | 12/1960 | Soffer et al. | 222/402.22 |
| 3,168,059 | 2/1965 | Germann . | |
| 3,404,863 | 10/1968 | Green . | |
| 3,450,316 | 6/1969 | Barker | 222/402.22 |
| 4,045,938 | 9/1977 | Hansen | 222/402.22 |
| 4,165,825 | 8/1979 | Hansen | 222/402.22 |
| 4,171,074 | 10/1979 | Diamond . | |
| 4,461,406 | 7/1984 | Vannucci | 222/513 |

*Primary Examiner*—H. Grant Skaggs

*Attorney, Agent, or Firm*—Fay, Sharpe, Beall, Fagan, Minnich & McKee

[57] ABSTRACT

A dispensing valve particularly suited for use on the outlet nozzle of a membrane type beverage container comprises a first unitary component formed from a resilient resinous material and having a generally cylindrical main body with opposed axial ends. One of the ends includes an axially open circumferential groove adapted to sealingly receive and be retained on the outer end of the outlet nozzle. A circumferentially continuous seat lies radially inwardly of the groove. An opening extends axially through the body and has one end closed by a cylindrical closed end tubular portion. Assembled in the main body is an integral valve element and dispensing tube component comprising an imperforate valve disk having opposed faces and a diameter at least greater than the maximum diametric extent of the seat. A hollow dispensing tube is joined centrally to one face of the disk and extends axially thereof into the tubular portion of the main body. The dispensing tube has an inlet port formed at a location adjacent the disk and an outlet port adjacent the end of the tube remote from the disk. A radially extending flange is carried on the tube at a location intermediate the inlet and outlet ports. The flange is engaged by the body and biased in a direction to cause the disk to sealingly engage the seat.

5 Claims, 2 Drawing Sheets

DISPOSABLE VALVE WITH DISK-LIKE VALVE ELEMENT

BACKGROUND OF THE INVENTION

The subject invention is directed toward the art of valves and, more particularly, to a valve assembly which is particularly suited for use as a dispensing valve or faucet for bag-in-the-box type beverage containers.

Many different dispensing valve assemblies are used with bag-in-the-box or membrane type beverage containers. Typically the valves have included tiltable or deflectable plug-like elements mounted in the outlet nozzle of the beverage container. Valves of this general type are shown, for example, in U.S. Pat. Nos. 3,443,728 and 3,972,452. In each of these prior valves, the valve element seals against the interior of the beverage container outlet nozzle. Thus, slight defects or irregularities in the interior of the outlet nozzle can result in leakage taking place.

Prior valves also prevent special problems with respect to maintaining them in a sanitary condition during shipping. Typically, it has been necessary to apply a separate removable dirt cover element over the entire valve and/or the discharge nozzle.

BRIEF DESCRIPTION OF THE INVENTION

The subject invention provides an extremely simple two component valve design which does not use the interior of the discharge nozzle as a valve seat surface. In addition, the design is such that an integral portion of one of the components encloses and seals the valve element against contamination until it is desired to use the valve and its dispensing function. In accordance with the subject invention there is provided a dispensing valve which is particularly suited for use on the outlet nozzle of a membrane type beverage container. The valve of the invention comprises a first unitary component formed from a resilient resinous material and having a generally cylindrical main body with opposed axial ends. One of the axial ends includes an axially open circumferential groove adapted to sealingly receive and be retained on the outer end of the outlet nozzle on the beverage bag. A circumferentially continuous seat lies radially inward of the groove and extends axially outward. An opening extends axially through the body from one end to the other. The opening has an enlarged portion in the one axial end centrally within the seat and a cylindrical closed end tubular portion extends outwardly from the other axial end about the opening. Mounted within the first unitary component is an integral valve element and dispensing tube component which comprises an imperforate disk having opposed faces and a diameter at least greater than the maximum diametric extent of the seat. A hollow dispensing tube is joined centrally to one face of the disk and extends axially thereof into the tubular portion of the main body. The dispensing tube has an inlet port formed in the wall of the tube at a location adjacent the disk. An outlet opening is formed adjacent the end of the tube remote from the disk. Carried on the tube at a location immediate the inlet and outlet ports is a radially extending flange which is engaged by the body and biased in a direction to cause the disk to sealingly engage the seat.

Because of the relationship between the valve element and dispensing tube component with the main body, a continual bias is maintained on the disk to cause it to seal against the seat. Additionally, the dispensing tube portion of the assembly is totally enclosed by the tubular portion of the main body which extends outwardly about the central opening. This tubular portion acts to shield the dispensing nozzle and the interior of the valve from contamination during shipping, handling and storage of the valve and beverage container assembly.

Preferably, and in accordance with a more limited aspect of the invention, the inlet port is located to lie within the enlarged end of the central opening such that tilting of the dispensing tube relative to the main body causes the valve disk to move away from the seat and permit flow to take place directly from the interior of the bag to the inlet opening in the dispensing tube.

Accordingly, a primary object of the subject invention is a provision of an extremely simple two component valve assembly wherein the interior of the valve is closed and protected until it is desired to us the valve in its dispensing function.

Yet another object of the invention is the provision of a valve which can be made from only two, relatively simple plastic moldings.

BRIEF DESCRIPTION OF THE DRAWINGS

The above and other objects and advantages will become apparent from the following description when read in conjunction with the accompanying drawings wherein:

Referring more particularly to the drawings wherein the showings are for the purpose of illustrating a preferred embodiment of the invention only, and not for the purpose of limiting same, FIG. 1 shows the overall arrangement of a dispensing valve 10 mounted on the outer end of an outlet nozzle 12 of a conventional membrane or bag-in-the-box type beverage container (not shown). The nozzle 12 forms no particular part of the invention and is shown as a generally circular plastic outlet nozzle having a continuous side wall 14 and one or more radially extending flanges 16 and 18. The flanges provide means for connecting associated valves, flow lines and the like.

FIGS. 2 and 3 best illustrate the dispensing valve 10. As shown therein, the dispensing valve 10 comprises a main, generally cylindrical body section 20 which is formed from a suitable resilient elastomeric material such as silicone rubber or the like. For the purposes of the subject invention, the body material has a relatively high degree of resiliency and elasticity. The body 10 has opposed end faces 22 and 24 and a suitable circumferential recess 26 extends axially into body 20 from end face 24. Recess 26 is sized and shaped to closely and tightly receive the outer free end of the outlet nozzle 12. An opening 28 extends axially through the body 20 and includes an enlarged recess section 30 adjacent the end face 24.

Figure 3:
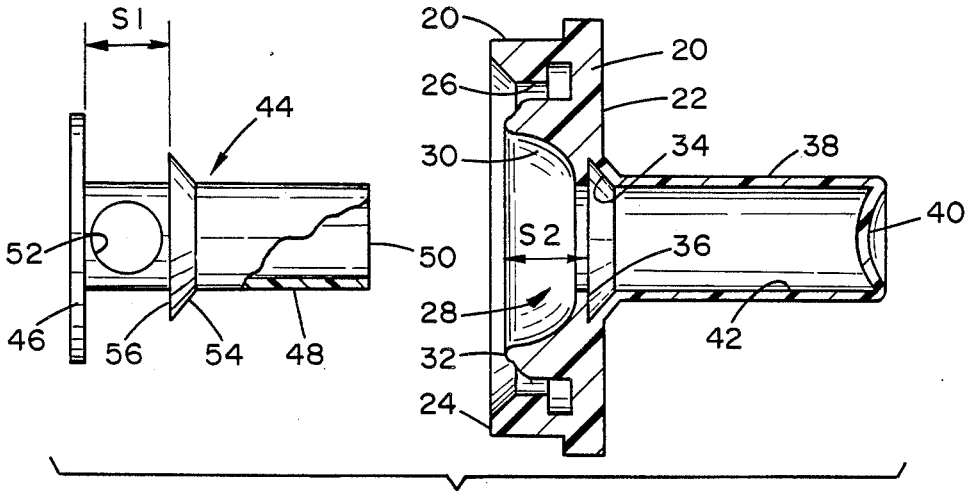
FIG. 3 is an exploded view in cross-section of the components which must be assembled to form the dispensing valve of FIG. 1.

Closely surrounding the recess 30 and continuous thereabout is a raised bead type of valve seat 32. Seat 32 faces axially outwardly from the body and is concentric with the opening 28. As best illustrated in FIG. 3, an internal crcumferential groove 34 extends about the right hand end opening 28. Recess 34 thus defines an internal shoulder 36 which lies generally perpendicular with the axis of body 20.

Formed integrally with the body 20 and extending axially from the right hand end face 22 is a resilient tubular section 38. Tubular section 38 has a closed end wall 40 and an open interior passage 42 which is generally of the same diameter as the outlet end of passageway or opening 28.

Figure 1:
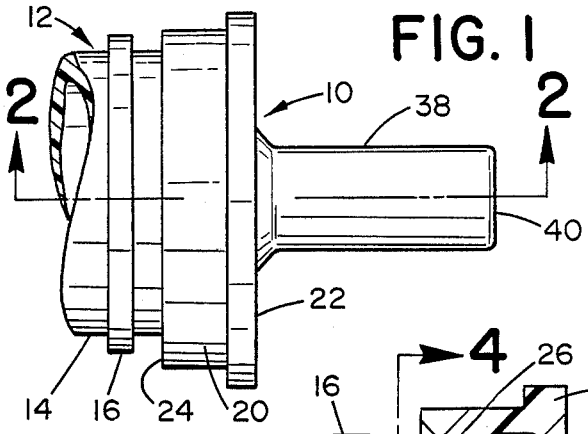
FIG. 1 is a side elevational view of a dispensing valve formed in accordance with the preferred embodiment of the subject invention.
Figure 2:
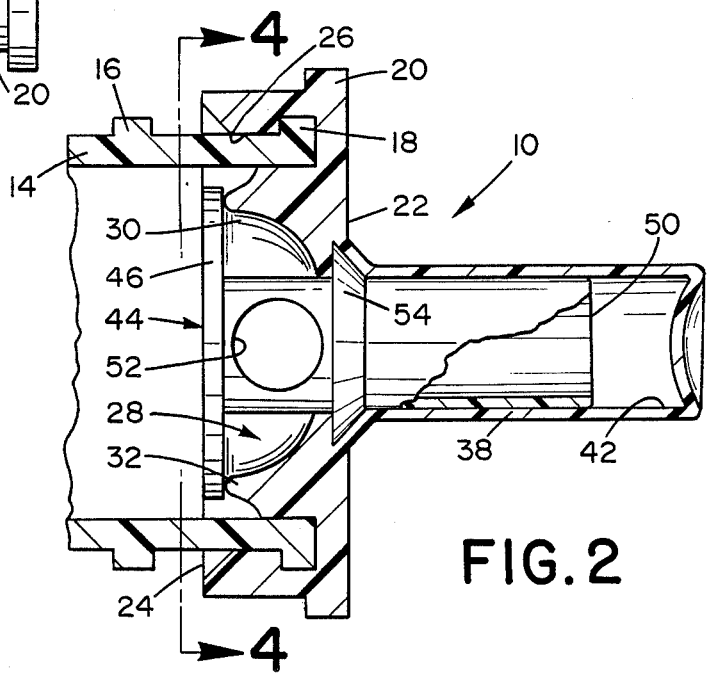
FIG. 2 is a cross-sectional view taken along line 2—2 of FIG. 1.
Figure 4:
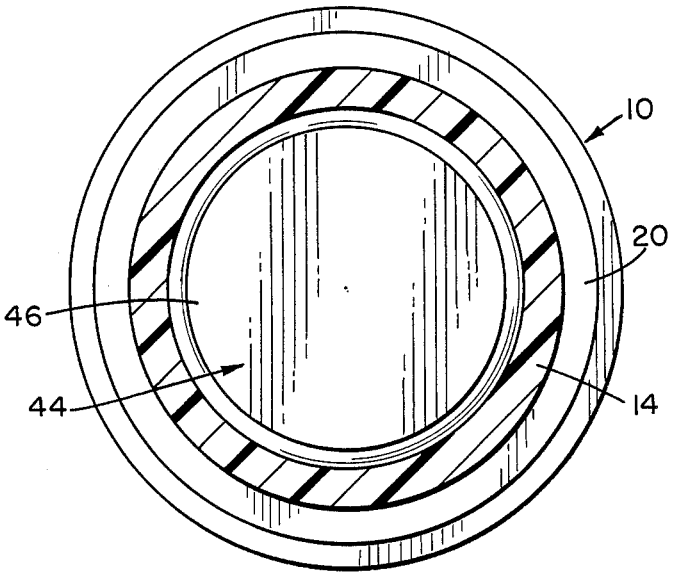
FIG. 4 is cross-sectional view taken on line 4—4 of FIG. 2.

As best illustrated in FIGS. 2 and 3 an integral valve element and dispensing tube component 44 is mounted within the resilient main body 20. Element 44 is formed from a material, preferably a resinous plastic material, having significantly greater rigidity and less resiliency than the material from which body 20 is made. More particularly, the element 44 comprises a circular valve disk element 46 which is relatively thin and has a circular outer periphery as best shown in FIG. 4. The diameter of the disk element 46 is at least slightly greater than the maximum diametrical extent of the seat bead 32.

Extending outwardly from the right hand face surface of the disk 46 is a cylindrical dispensing tube element 48. Tube 48 is hollow and has an open outer free end 50. A pair of aligned inlet openings 52 extend through the side wall of the dispensing tube element 48 at a location closely adjacent the disk element 46. For reasons which will be apparent hereafter, the exterior diameter of element 48 is only slightly larger than the interior diameter of tubular portion 38.

Positioned somewhat centrally about the exterior of the dispensing tube 50 is an outwardly extending flange member 54. The left hand face of flange 54 is generally perpendicular to the axis of tube 50. The right hand end is, as shown, inclined at an angle of about 45° relative to the axis. It is important to note that the flat face 56 of the flange 54 is located at a distance $S_1$ from the right hand face of the valve disk 46. It should also be noted that the shoulder 36 of the body 20 is located a distance $S_2$ from the outermost plane of the seat bead 32. The distance $S_2$ is, for reasons which will subsequently become apparent, slightly greater than the distance $S_1$.

The valve element and dispensing tube component 44 is assembled into the main body 20 by being driven axially into the opening 28. That is, the open end 50 of the dispensing tube 48 is driven axially into the opening 28 until the flange section 54 is received within the recess 34. At this time, the face 58 of flange 54 is engaged with the shoulder 36 of the recess 34. Because of the dimensional relationship between $S_1$ and $S_2$ ($S_1$ being less than $S_2$), the resilient body 20 causes the disk 46 to engage the seat bead 32 under a substantial sealing bias.

It should be noted that the exterior diameter of the dispensing tube 48 is preferably at least as great as or slightly greater than the diameter of the passage 42 in the tubular portion 38. Thus, the tubular portion 38 tightly engages about the exterior of the dispensing tube component 48.

When the two components are assembled in the relationship shown in FIG. 2, the outer open end 50 of the dispensing tube 48 is closed by being totally encompassed by and lying entirely within the closed end tubular section 38. Thus, the interior of the valve and the dispensing tube ar maintained in a totally enclosed sanitary condition during shipping, storage, and handling of the beverage container and its dispensing valve.

Figure 5:
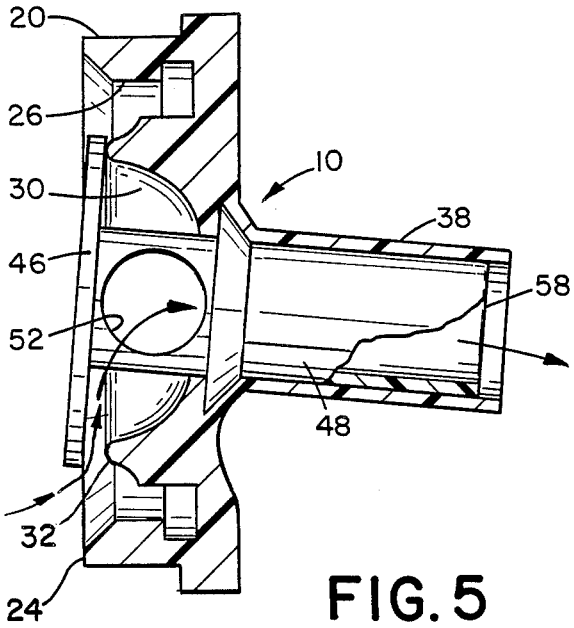
FIG. 5 is cross-sectional view similar to FIG. 2 but showing the valve in a dispensing position.

When it is desired to dispense fluid from the interior of the beverage container, the outer free end of the tubular portion 38 is cut off as illustrated in FIG. 5. The interior of the dispensing tube and the open end 50 are then exposed to the ambient atmosphere. At this time, pushing laterally against the side of the tubular portion 36 and the dispensing tube 48 causes the disk valve element 46 to pivot and at least a portion of the disk 46 moves away from the seat bead 32. Fluid can then flow from the interior of the dispensing nozzle to chamber 30 and through opening 52 to the interior of the dispensing tube 48 and out the open nozzle end 50. Releasing the nozzle allows it to return to its central position wherein the valve disk 46 is in sealing engagement with the seat bead 32

As is apparent from the foregoing, the subject invention provides an extremely simple two component dispensing valve assembly wherein all sealing is accomplished between internal elements of the valve itself. The valve arrangement does not require that the interior of the dispensing nozzle of the beverage bag be used as a sealing or valving surface. Moreover, the design of the subject valve is such as to maintain all fluid contacting surfaces within the valve totally enclosed and sealed during shipping and handling of the valve. The subject arrangement does not require a separate seal element to be applied and removed from the valve itself but rather relies on an integral part of the original main valve body molding.

The subject invention has been described in great detail sufficient to enable one of ordinary skill in the dispensing valve art to make and use the same. Obviously, modifications and alterations will occur upon a reading and understanding of the subject specification. It is intended to include all such modifications as part of the invention insofar as they come within the scope of the appended claims.

What is claimed is:

1. A dispensing valve particularly suited for use on the outlet nozzle of a membrane type beverage container comprising:

a first unitary component formed from a resilient resinous material and having a generally cylindrical main body with opposed axial ends, one of said axial ends including an axially open circumferential groove adapted to sealingly receive and be retained on the outer end of said outlet nozzle, a circumferentially continuous seat lying radially inwardly of said groove and extending axially outward, an opening extending axially through said body from said one axial end to the other axial end, said opening having an enlarged end portion in said one axial end, and a cylindrical closed end tubular portion extending outwardly from said other axial end joined to said body about said opening;

an integral valve element and dispensing tube component comprising an imperforate disk having opposed faces and a diameter at least greater than the maximum diametric extent of said seat, a hollow dispensing tube joined centrally to one face of said disk and extending axially thereof, said tube having an inlet port formed in the wall thereof at a location adjacent said disk and an outlet port adjacent the end of said tube remote from said disk, a radially extending flange carried on said tube at a location intermediate said inlet and outlet ports; and, said valve element and dispensing valve component assembled in said main body with the tubular portion of said main body enclosing said tube and said outlet port, said radially extending flange being engaged by said body and biased thereby in a direction to cause said disk to sealingly engage said seat.

2. The dispensing valve of claim 1 wherein said tubular portion of said main body tightly engages said dispensing tube between said flange and said outlet orifice.

3. The dispensing valve as defined in claim 2 wherein said tubular portion of said main body extends beyond the outlet port in said tube and wherein the outer end of said tubular portion is closed.

4. The dispensing valve as defined in claim 1 with said radially extending flange on said dispensing tube is received and held within a groove formed about the interior of said opening.

5. The dispensing valve as defined in claim 1 wherein said inlet port is located within the enlarged end portion of said opening.

* * * * *